US007011072B2

(12) United States Patent
Nicholas

(10) Patent No.: US 7,011,072 B2
(45) Date of Patent: Mar. 14, 2006

(54) SHAFT NOISE DAMPER

(75) Inventor: Frank A. Nicholas, W. Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 3 days.

(21) Appl. No.: 10/823,430

(22) Filed: Apr. 13, 2004

(65) Prior Publication Data

US 2005/0224037 A1 Oct. 13, 2005

(51) Int. Cl.
*F02D 9/08* (2006.01)

(52) U.S. Cl. ..... 123/336; 123/337

(58) Field of Classification Search ..... 123/336, 123/337
See application file for complete search history.

(56) References Cited

U.S. PATENT DOCUMENTS 5,669,350 A * 9/1997 Altmann et al. ..... 123/337
6,763,802 B1 * 7/2004 Brassell ..... 123/184.61

* cited by examiner

*Primary Examiner*—Noah P. Kamen
(74) *Attorney, Agent, or Firm*—Jimmy L. Funke

(57) ABSTRACT

An internal combustion engine including an air intake manifold having a rotary valve for regulating air flow within the manifold. The valve comprises a cylindrical shaft formed of stainless steel and butterfly vanes formed of plastic overmolded onto the shaft. The composite valve has a natural frequency of about 300 Hz and can resonate with engine noise. In accordance with the invention, the valve shaft is additionally provided with one or more sound-absorbing elastomeric dampers, formed preferably of a silicone rubber, that make contact with saddles in the intake manifold for extinguishing harmonic frequency response of the valve below 660 Hz. Preferably, the plastic butterfly vanes also are overcoated with the elastomer to further damp harmonic flexure and wave propagation in the valve.

12 Claims, 3 Drawing Sheets

SHAFT NOISE DAMPER

TECHNICAL FIELD

The present invention relates to control of noise generated by internal combustion engines; more particularly, to such engine noise as may be amplified by harmonic resonance of engine components; and most particularly to a damper mechanism for suppressing such harmonic resonance of a shaft to minimize total engine noise.

BACKGROUND OF THE INVENTION

It is well known that internal combustion engines generate noise over a range of sound frequencies during engine operation. Such noise can originate from mechanical, hydraulic, and/or pneumatic actions of various engine and auxiliary components, and amplitude of the noise can be a function of the revolutionary speed of the engine. In engine applications such as powering a vehicle, other components such as transmissions, brakes, and the like can also contribute to the overall noise level. It is generally recognized as being desirable to minimize the audible noise emitted by an engine and/or corresponding vehicle under all conditions of operation. Noise frequencies of interest are typically within the range of less than 660 Hz.

It is further known that some of these various engine and vehicle components may have one or more natural harmonic frequencies, and that those components can be excited to resonate undesirably when their resonant frequencies are also present in an engine and/or vehicle sound emission spectrum, thereby amplifying those frequencies and increasing the overall level of perceived noise.

A particular example of a resonant component is a rotatable shaft of an airflow tuning valve in a tunable intake manifold. In an exemplary prior art embodiment, the valve shaft has a free resonant length of about 226 mm between restraining bearings and a resulting natural resonant frequency of about 300 Hz. Air flowing past the central portions of the shaft can cause the prior art shaft to resonantly respond like a reed undesirably at this frequency.

What is needed in the art is dampening mechanism for reducing the natural resonant response of a shaft used in a vehicle powered by an internal combustion engine.

SUMMARY OF THE INVENTION

Briefly described, an internal combustion engine in accordance with the invention includes an air intake manifold having a rotary valve for regulating air flow within the manifold. In the prior art, the valve comprises a cylindrical shaft formed of stainless steel and butterfly vanes formed of plastic overmolded onto the shaft. The valve has a natural frequency of about 300 Hz and can resonate with engine airflow pulsations, generating additional noise.

In accordance with the invention, the valve shaft is additionally and novelly provided with one or more energy-absorbing elastomeric dampers, formed preferably of a silicone rubber, that make contact at saddles in the intake manifold body for extinguishing harmonic frequency response of the valve below 660 Hz, the residual harmonic frequencies being higher than 660 Hz. Preferably, the plastic butterfly elements also are overcoated with the elastomer to further damp harmonic flexure and wave propagation in the valve.

BRIEF DESCRIPTION OF THE DRAWINGS

The present invention will now be described, by way of example, with reference to the accompanying drawings, in which.

DESCRIPTION OF THE PREFERRED EMBODIMENTS

Figures 1, 2:
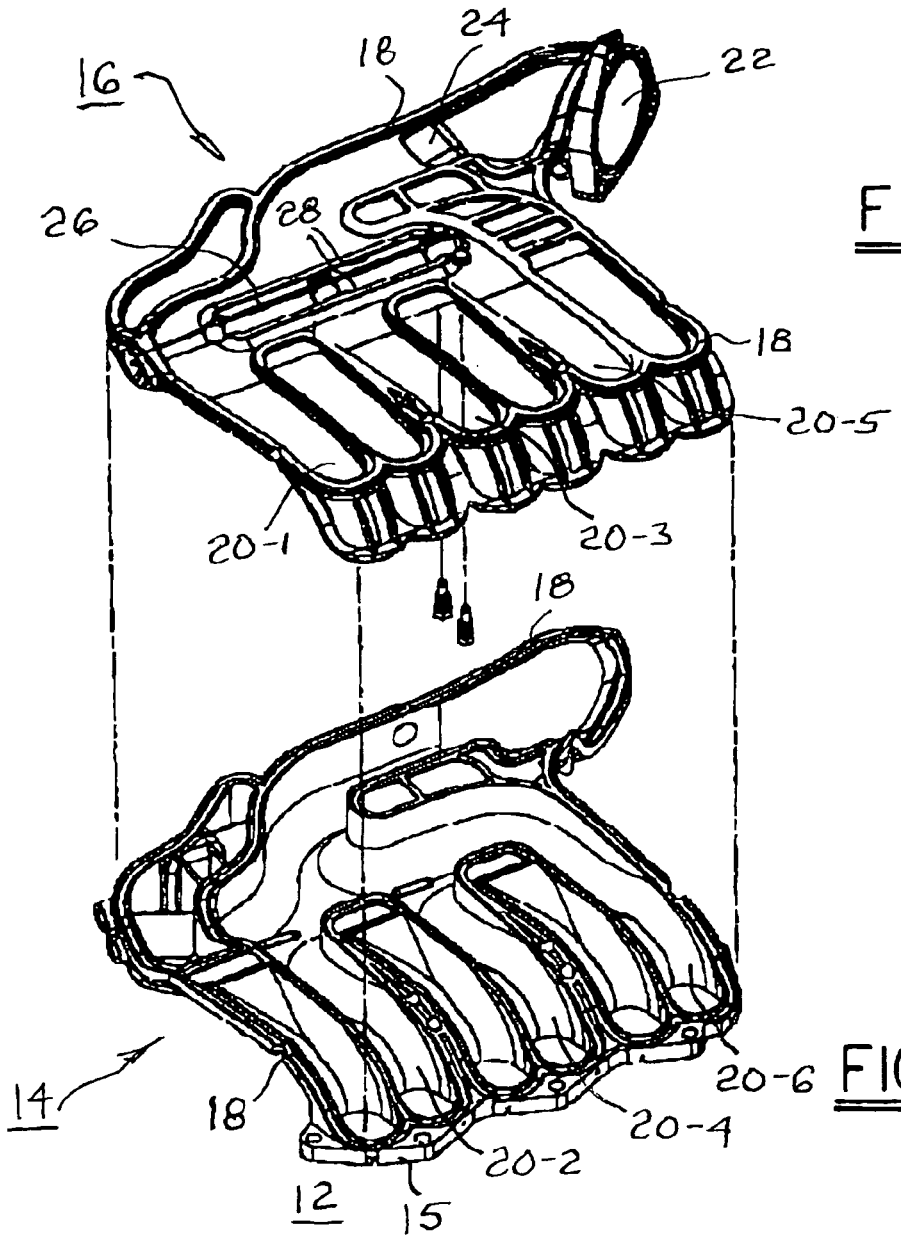
FIGS. 1 and 2 are isometric views from above of center and bottom elements, respectively, (top element omitted for clarity) of a welded intake manifold assembly for a six-cylinder engine.
Figure 3:
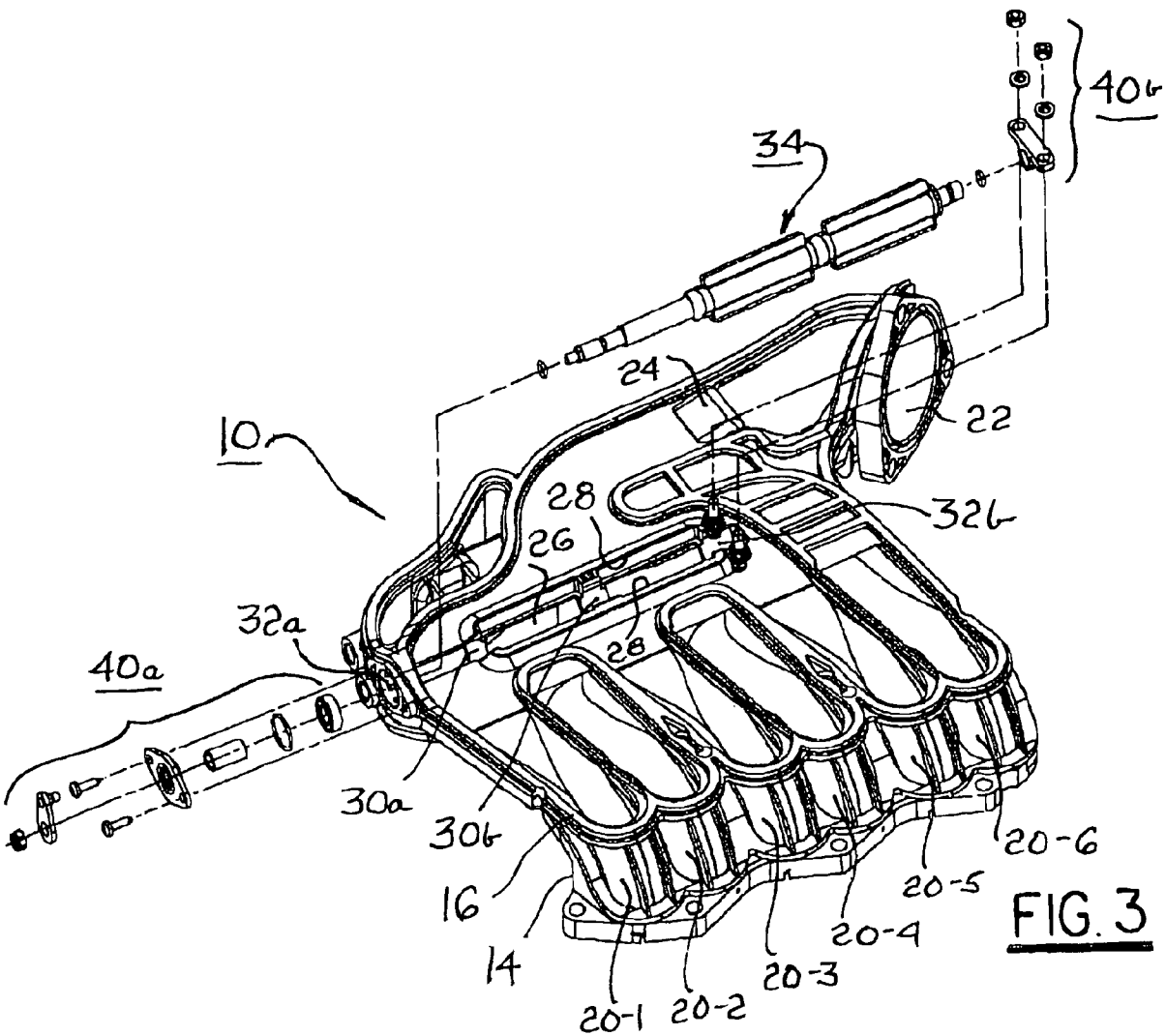
FIG. 3 is an isometric view from above, in exploded relationship, showing the center and bottom elements from FIGS. 1 and 2 assembled and further showing a rotary butterfly valve for insertion into the assembly to fine-tune the distribution of air between the bottom and top elements.
Figure 4:
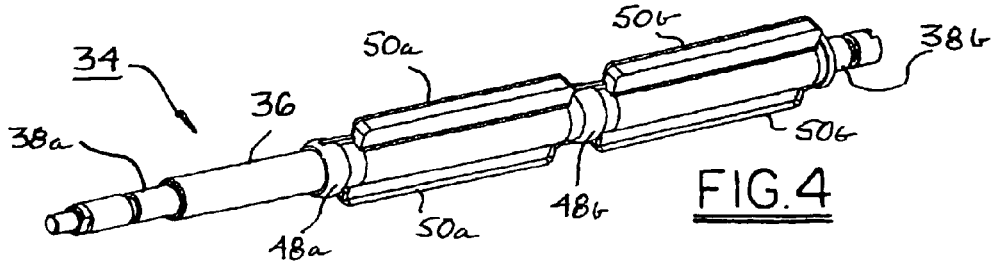
FIG. 4 is an isometric view from above of a rotary butterfly valve in accordance with the invention.
Figure 5:
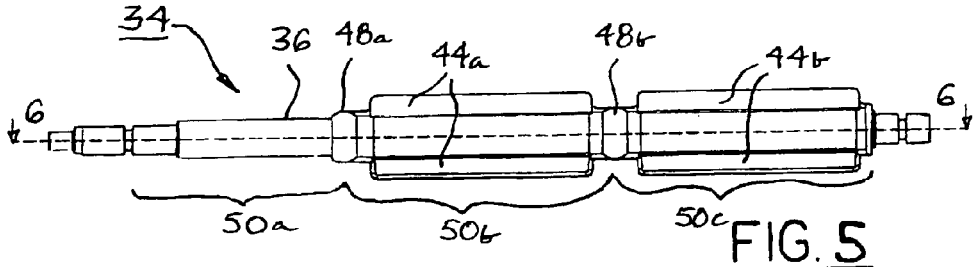
FIG. 5 is an elevational view of the rotary butterfly valve shown in FIG. 4.
Figure 6:
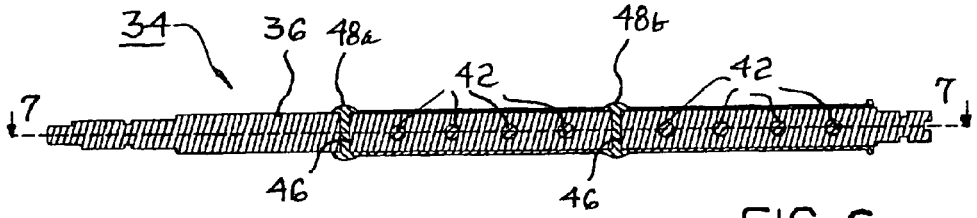
FIG. 6 is a first longitudinal cross-sectional view taken along line 6—6 in FIG. 5.
Figure 7:
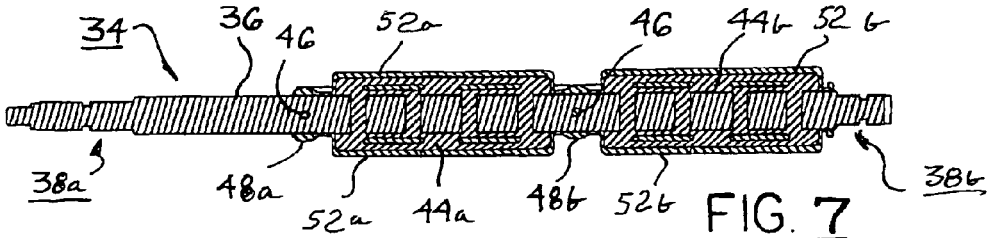
FIG. 7 is a second longitudinal cross-sectional view taken along line 7—7 in FIG. 6 at 90° to the view shown in FIG. 6.

Referring to FIGS. 1 through 3, an air intake manifold sub-assembly 10 (referred to herein as "manifold" 10) for an internal combustion engine 12 includes a bottom element 14 and a center element 16. (A top element obviously is necessary to complete manifold 10 for use but is omitted here for clarity.) Elements 14,16 are formed generally in accordance with the prior art, for example, by injection molding of appropriate plastic polymer, and are conventionally weldable as by ultrasonics along weld ridges 18 to form manifold 10. Manifold 10 is arranged for use with an inline six-cylinder engine, but obviously similar manifolds are possible for other engine configurations. Manifold 10 is also configured for operational fine-tuning of airflows to the various cylinder runners 20. Runners 20-1,20-3,20-5 ("upper runners") are formed in center element 16 and supply air to cylinders 1, 3, and 5 (not shown), respectively, of engine 12. Runners 20-2,20-4,20-6 ("lower runners") are formed in bottom element 14 and supply air to cylinders 2, 4, and 6 (not shown), respectively, of engine 12. Bottom element 14 includes a ganged flange 15 for attaching manifold 10 to engine 12. Air enters manifold 10 via intake opening 22 and is divided by airfoil septum 24 into approximately equal flows into bottom and center elements 14,16.

Center element 16 includes an elongate aperture 26 for air flow communication between the upper and lower runners within manifold 10. Aperture 26 includes elongate lips 28 and first and second saddle mounts 30*a*,30*b* coaxial with first and second bearing mounts 32*a*,32*b* for receiving a butterfly valve 34 for regulating air flow through aperture 26.

Referring to FIGS. 3 through 7, butterfly valve 34 comprises a shouldered, cylindrical central shaft 36 formed preferably of stainless steel and having conventional first and second ends 38*a*,38*b* for receiving conventional bearing and/or bushing elements 40*a*,40*b* to mount shaft 36 into mounts 32*a*,32*b*, respectively, for rotation in aperture 26 of center element 16.

Shaft 36 is provided with a plurality of transverse holes 42 which act as anchors for first and second butterfly vanes 44*a*,44*b* extending radially from shaft 36, which vanes may be formed as by plastic overmolding. In use, vanes 44*a*,44*b* cooperate with lips 28 by controlled rotation of shaft 36 to regulate flow of air through aperture 26. A currently preferred material for forming vanes 44*a*,44*b* is Nylon PA66.

Shaft 36 is further provided with a second set of transverse anchor holes 46, formed preferably at 90° from holes 42, for the additional overmolding of first and second annular elastomeric resilient dampers 48*a*,48*b* onto shaft 36 in accordance with the invention. Resilient dampers 48*a*,48*b* define circumferential rings around shaft 36 between vanes 44*a*,44*b* and adjacent vane 44*a*. The dampers are thus located at positions approximately one-third of the distance between ends 38*a*,38*b* and coincide with the positions of first and second saddle mounts 30*a*,30*b* in center element 16. Shaft 36 is thus divided by dampers 48*a*,48*b* into three approximately equal free spans 50*a*,50*b*,50*c*, each having a resonance frequency about three times higher than the natural resonance frequency of the undamped prior art shaft and well above the threshold limit of interest of 660 Hz, each span being acoustically grounded to center element 16 via saddle mounts 30*a*,30*b*.

Of course, some engine or vehicle components, when damped in accordance with the invention, may have no particular natural resonant frequency, in which case the "change" in natural frequency is the elimination thereof, an outcome fully anticipated by the present invention.

Preferably, the diameter of resilient dampers 48*a*,48*b* is selected to be slightly greater than the diameter of saddle mounts 30*a*,30*b* such that an interference fit therebetween exists at assembly. Preferably, the diameter of dampers 48*a*,48*b* is between about 0.1 mm and about 0.5 mm greater than the diameter of saddle mounts 30*a*,30*b*. The interference during assembly and subsequent use is accommodated by the compressible nature of the elastomer. The elastomer may tend to wear during use of the valve, but the initial interference fit coupled with the tendency of the elastomer to swell slightly in a gasoline-vapor environment assures that acoustic contact is maintained with the saddle mounts over the working lifetime of the engine.

A currently-preferred elastomer is silicone rubber, for example, No. M54633, although other suitable elastomers are fully contemplated by the invention. A preferred durometer value for the elastomer is about 55.

Preferably, elastomer is also overmolded onto vanes 44*a*, 44*b* to form vane lips 52*a*,52*b*, thereby further reducing the acoustic response of valve 34 by resilient damping of wave propagation along vanes 44*a*,44*b*.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In an internal combustion engine, a rotary valve assembly comprising a shaft rotatable about an axis and having a hole transverse to the axis; and at least one elastomeric damper for changing a resonant frequency of said shaft, said damper being molded onto the shaft and comprising an anchor portion extending within the hole.

2. A valve assembly in accordance with claim 1 wherein said resonant frequency is less than about 660 Hz.

3. A valve assembly in accordance with claim 1 further including a rotary air control valve mounted on the shaft apart form the damper.

4. A valve assembly in accordance with claim 1 disposed within said engine, wherein said at least one elastomeric damper is disposed between said shaft and said engine whereby said shaft is acoustically grounded to said engine for changing said resonant frequency of said shaft.

5. A valve assembly in accordance with claim 4 wherein the shaft is rotatably mountable to said engine at opposite ends of said shaft.

6. A valve assembly in accordance with claim 4 further comprising at least one butterfly vane disposed on said shaft.

7. A valve assembly in accordance with claim 6 wherein material forming said butterfly vane includes nylon.

8. A valve assembly in accordance with claim 6 wherein at least a portion of said butterfly vane includes an elastomer.

9. A valve assembly in accordance with claim 4 further comprising a plurality of said at least one elastomeric damper, said plurality of dampers being spaced apart along said shaft.

10. A valve assembly in accordance with claim 1 wherein said at least one elastomeric damper is formed from an elastomer having a durometer value of about 55.

11. A valve assembly in accordance with claim 1 wherein said at least one elastomeric damper is formed of silicone rubber.

12. A rotary valve assembly for an internal combustion engine comprising a shaft rotatable about an axis and having a first anchor hole transverse to the axis and a second anchor hole transverse to the axis and perpendicular to the first anchor hole;

a butterfly vane affixed to the shaft and including an anchor portion extending through the first anchor hole; and an elastomeric damper affixed to the shaft apart from the butterfly vane and including an anchor portion extending through the second hole, said elastomeric damper being effective to acoustically ground the shaft to the engine for changing the resonant frequency thereof.

* * * * *